US008256466B2

(12) United States Patent
Mattson

(10) Patent No.: US 8,256,466 B2
(45) Date of Patent: Sep. 4, 2012

(54) THERMAL INSULTED SEWER WATER TREATMENT ENVIRONMENT

(76) Inventor: Marlin J. Mattson, Newfolden, MN (US)

( * ) Notice: Subject to any disclaimer, the term of this patent is extended or adjusted under 35 U.S.C. 154(b) by 347 days.

(21) Appl. No.: 12/455,375

(22) Filed: Jun. 2, 2009

(65) Prior Publication Data

US 2010/0040414 A1 Feb. 18, 2010

Related U.S. Application Data

(60) Provisional application No. 61/189,016, filed on Aug. 15, 2008.

(51) Int. Cl.
*F16L 53/00* (2006.01)

(52) U.S. Cl. ..... 138/32; 138/110; 47/31

(58) Field of Classification Search ..... 138/32, 138/33, 110; 47/31, 29.1; 473/171; 5/420
See application file for complete search history.

(56) References Cited

U.S. PATENT DOCUMENTS

| | | | | | |
|---|---|---|---|---|---|
| 901,582 | A | * | 10/1908 | Austin | 405/43 |
| 2,927,626 | A | | 3/1960 | Corwin et al. | 156/198 |
| 3,162,566 | A | | 12/1964 | Katz | 428/74 |
| 3,420,022 | A | | 1/1969 | Brock | 52/302.1 |
| 3,863,387 | A | * | 2/1975 | Webster et al. | 47/29.1 |
| 4,038,447 | A | | 7/1977 | Brock | 428/72 |
| 4,450,193 | A | | 5/1984 | Staebler | 428/71 |
| 4,590,714 | A | * | 5/1986 | Walker | 250/585 |
| 4,629,364 | A | * | 12/1986 | Sayles et al. | 405/157 |
| 4,780,351 | A | * | 10/1988 | Czempoyesh | 428/122 |
| 5,064,308 | A | * | 11/1991 | Almond et al. | 405/43 |
| 5,174,685 | A | * | 12/1992 | Buchanan | 405/179 |
| 5,534,147 | A | * | 7/1996 | Kallenbach et al. | 210/605 |
| 5,654,060 | A | | 8/1997 | Holman et al. | 428/68 |
| 5,752,784 | A | * | 5/1998 | Motz et al. | 405/37 |
| 5,833,401 | A | * | 11/1998 | Olson | 405/129.75 |
| 5,836,716 | A | * | 11/1998 | Johnson et al. | 405/43 |
| 6,705,800 | B2 | * | 3/2004 | Ring et al. | 405/46 |
| 6,739,088 | B1 | * | 5/2004 | Stoller | 47/31 |
| 6,835,312 | B2 | * | 12/2004 | Perriello et al. | 210/610 |
| 6,878,427 | B2 | | 4/2005 | Schmidt et al. | 428/71 |
| 6,901,697 | B1 | * | 6/2005 | Stoller | 47/31 |
| 2004/0096619 | A1 | | 5/2004 | DiChiara, Jr. | 428/76 |
| 2005/0172548 | A1 | * | 8/2005 | Bement | 47/23.1 |
| 2007/0020412 | A1 | * | 1/2007 | Kumamoto et al. | 428/34.2 |

OTHER PUBLICATIONS

"Freezing Problems With Onsite Sewage Treatment Systems" Regents of University of Minnesota Nov. 27, 2006.

"Checking Frozen Septic Systems to Prevent Future Problems" Regents of University of Minnesota Nov. 27, 2006.

* cited by examiner

*Primary Examiner* — Patrick F Brinson
(74) *Attorney, Agent, or Firm* — Richard John Bartz

(57) ABSTRACT

A sewer water treatment system having a septic tank and drain field is protected from freezing and becoming nonfunctional with a thermal insulation blanket. A plurality of stakes connected to the borders of the blanket extend into the ground to hold the blanket on the ground above the sewer water treatment system.

14 Claims, 3 Drawing Sheets

THERMAL INSULTED SEWER WATER TREATMENT ENVIRONMENT

CROSS REFERENCE TO RELATED APPLICATION

This application claims the benefit of U.S. Provisional Application Ser. No. 61/189,016 filed Aug. 15, 2008.

FIELD OF THE INVENTION

The invention concerns the art of environmental protection of underground water treatment systems from freezing and becoming nonfunctional in cold weather climates. Water treatment systems combined with thermal insulated blankets comprise the art field of the invention.

BACKGROUND OF THE INVENTION

Residential buildings in areas that do not have municipal sewer systems including sewage treatment facilities have sewage handling systems that include septic tanks and tiles or pipes in drain fields. The septic tanks and tiles are located below ground to allow the sewer water and organic particulates to filter and biodegrade in the soil. The septic tanks and tiles are normally located below the frost level to prevent freezing of the sewer water and blockage of the sewer system. Environment regulations have been established to limit the depth of the sewer water tiles to no more than three feet or one meter to reduce ground water, lake and river contamination. Sewer water in cold climates will freeze when located three feet or less below grade or ground. Organic materials, such as straw, hay and corn stalks have been used to cover the ground over septic tanks and drain fields containing sewer tiles to inhibit freezing of the sewer water in the septic tank and drain tiles. The organic materials draws moisture and attracts rodents. Wind can scatter these materials thereby exposing the ground over the septic tank and drain field to the cold elements. The disadvantages of organic materials for covering septic tanks and drain fields have been overcome by the thermal water treatment environment of the invention.

SUMMARY OF THE INVENTION

The invention is a thermal insulated water treatment environment having water treatment structure and drain fields located underground and protected from freezing in cold weather climates. One or more thermal insulation blankets located on the ground above the water treatment structure and drain fields are used to inhibit freezing of water treatment structure and drain fields. Fasteners, such as stakes, engageable with the blankets extend into the ground to hold the blankets on the ground above the water treatment structure and drain fields. The water treatment structure includes septic tanks for receiving waste water and solids from residential homes and porous tiles or tubular members for carrying water from the septic tanks to the drain fields. The blankets having first and second sheet members having outer peripheral flanges connected together to confine a core of thermal insulation material between the sheet members. Ring members, such as grommets and stitches around holes, connected to the flanges accommodate the stakes to apply lateral forces on the blankets and hold the blankets on the ground over the septic tank and drain fields whereby the blankets and air in the soil below the blankets inhibit freezing of the water in the septic tank and drain fields. The blankets are made of lightweight flame retardant materials that can be turned into rolls for convenient storage and use. The thermal insulation of the water treatment structure is achieved without electric power and is compatible with the environment.

DESCRIPTION OF THE INVENTION

Figure 1:
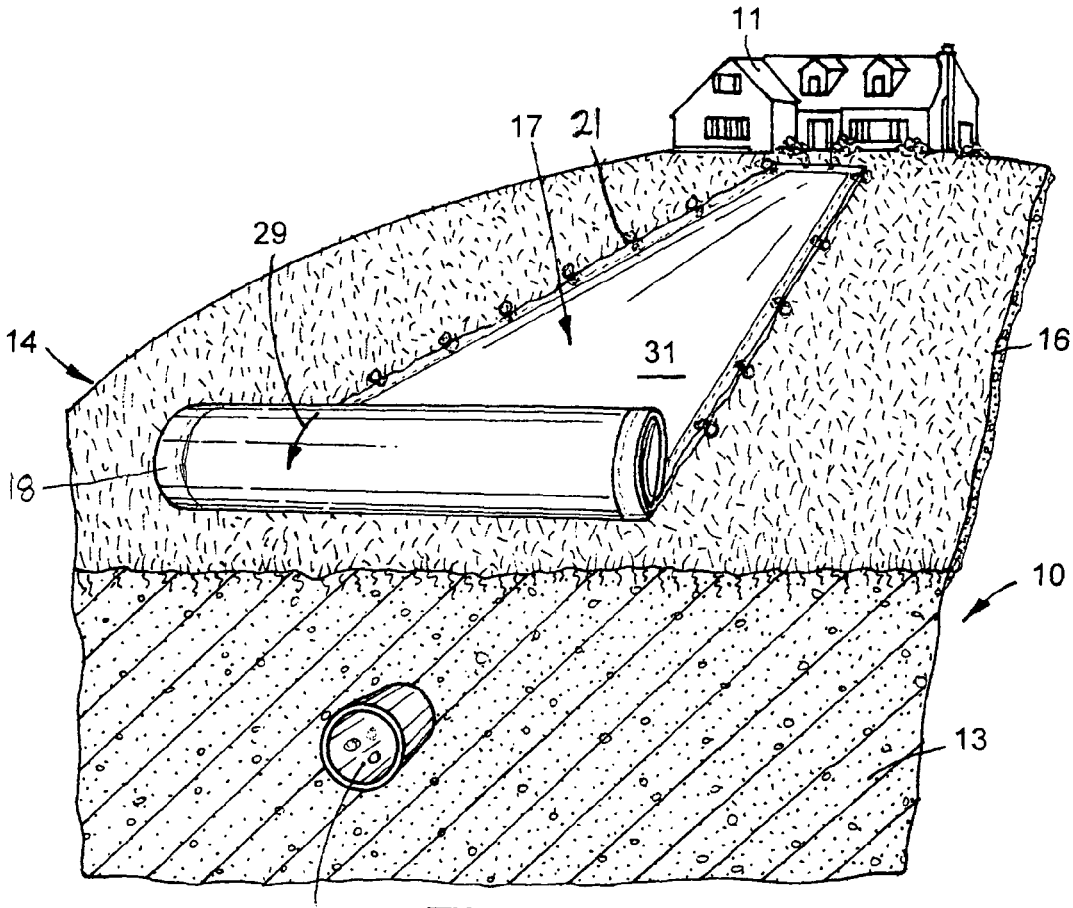
FIG. 1 is a perspective view of the combined sewer water drain field and thermal insulation blanket of the invention.

A sewer water drain field 10, shown in FIG. 1, extends away from a building 11, illustrated as a residential house, is used to filter the sewer water through ground 13. Building 11 can be a commercial or industrial structure, shop or garage. A pipe or tile 12 located under ground 13 carries water and gas from building 11 to a septic tank and from the septic tank to drain field 10. Tile 12 is a porous tubular member used to carry water from a septic tank. The water and gas is dispensed into ground 13 adjacent tile 12 where organic materials and microorganisms are biodegraded and the water is filtered as it flows down into the ground. The septic tank located underground traps and holds solids in the waste water. The solids settle to the bottom of the tank and form over time sludge and scum. Water in the top section of the tank flows out into one or more drain tiles 12 and discharges through holes 15 in tile 12 into the ground or soil around tile 12. The water in the septic tank and tile between building 11 and the tank and tile 12 and ground 13 around tile 12 must not freeze up and stop the functioning of the solids and water treatment system.

Pipe 12 has a plurality of holes 15 that allow water and organisms to flow into ground 13. The ground particulates or soil filters the water and allow for oxygenation of the organism and organic matter in the water. A pipe or tile located underground is used to carry sewer solids and water from building 11 to a septic tank or sewer system. A plurality of underground pipes or tiles can be used to carry water and gas from a septic tank and dispense the water and gas into ground 13. The gas has an oxygen content that elutes into ground 13 around and above tile 12. The oxygen aids in the biodegration of organisms, bacterial, fungi, and viruses. The soil particles, sand and rocks allow the water to migrate downward in ground 13 and the gas to flow upward to turf 14. The gas and ground 13 and air in ground 13 around and above tile 12 has heat generating microorganism action and thermal insulation properties that mitigate freezing of water in tile 12 and surrounding ground. The water and ground 13 around tile 12 and entire upper portions 20 of drain field can freeze into a solid mass in extreme cold weather. When atmospheric temperature falls to minus 40° or 50° F., the ground can have a frost depth of 3 to 4 meters. Under these cold weather conditions the entire drain filed will be frozen and nonfunctional.

Figure 2:
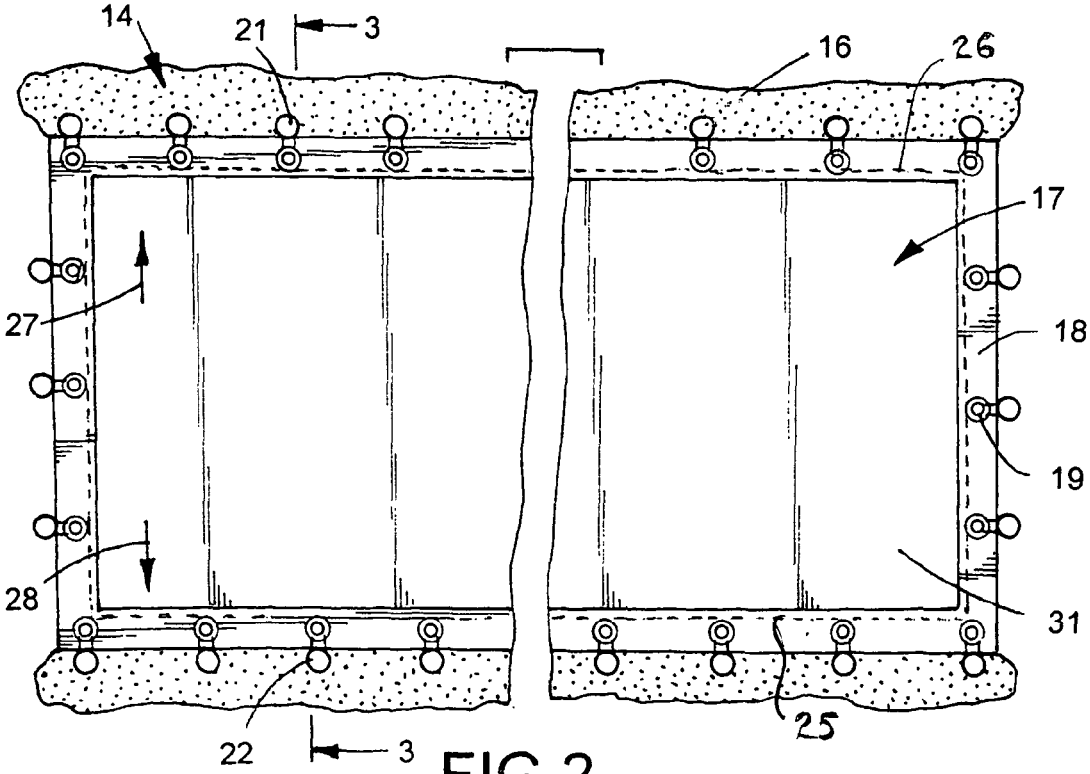
FIG. 2 is an enlarged top plan view of FIG. 1.
Figure 3:
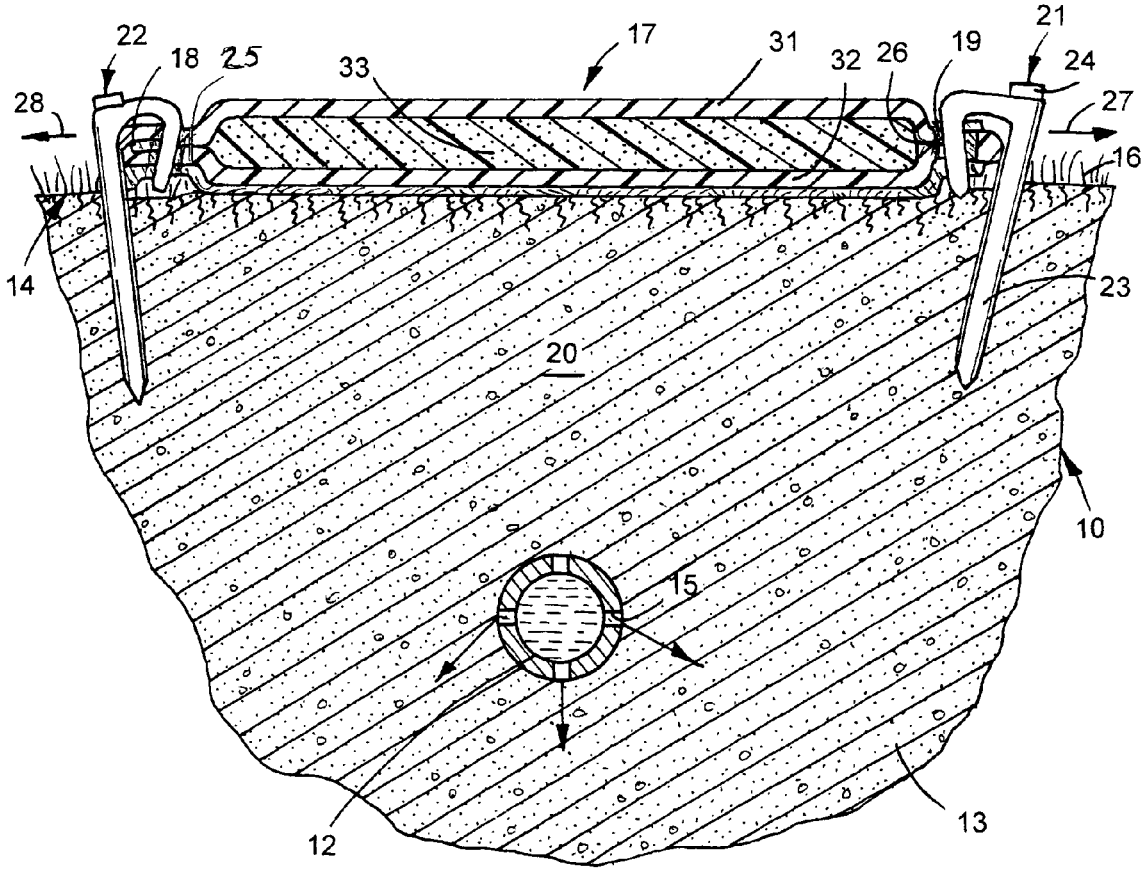
FIG. 3 is an enlarged Sectional view taken along line 3-3 of FIG. 2.

As shown in FIG. 1 to 3, an elongated insulated cover or blanket 17 located on turf 14 or surface of ground 13 protects the waste water system including the septic tank, drain field 10 and water in pipe 12 from freezing in cold weather environments. The functioning of the sewer system for building 11 is maintained operational during the cold weather season. Blanket 17 can also be used to cover underground water pipes between a water well and building 11. Blanket 17 located on the surface of turf 14 shields ground 20 under blanket from surface water that can saturate ground 20 and replace air in ground 20 and inhibit normal functioning of the water treatment system. Blanket 17 is made of durable waterproof materials having fire retardant specifications. Blanket 17 is an air and water impervious member having cover sheets or members 31 and 32 located on opposite sides of a flexible and flat core 33 of thermal insulation material. The thermal insulation material can be an open or closed cell foam plastic, a glass fiber mat or a plastic body having encapsulated air cells that substantially fills the space between cover members 31 and 32. The thermal insulation material has substantially uniform thickness throughout its width and length. The cover members 31 and 32 are secured together with an outer peripheral border 18. Stitches 25 and 26 or other fasteners are used to retain flange 18 in a flat and air tight condition. Border 18 does not allow water from entering core 33. The air in core 33 is confined within blanket 17 whereby core 33 and air functions as thermal insulation.

As shown in FIG. 3, border 18 supports a plurality of laterally spaced rings or grommets 19. Other types of openings, such as holes reinforced with stitches, can be incorporated into border 18. Stakes or posts 21 and 22 adapted to be driven to ground 13 engage border 18 to hold blanket in firm engagement with turf 14 over drain field 10 above tile 12. The stakes 21 and 22 apply opposite lateral forces, shown by arrows 27 and 28, and downward forces on blanket 17 along the length thereof to inhibit cold air and water from flowing under blanket 17 and freezing ground area 20 above tile 12 and septic tank. Blanket 17 also retains some of the air and gas from tile 12 in ground area 20 and prevents water, ice and snow from covering turf 14 above tile 12. In early fall blanket 17 holds snow for added thermal insulation.

The stakes 21 and 22 attached to border 18 cooperate to hold blanket 17 in firm engagement with turf 14 over drain field 10. The thermal insulation features of blanket 17 and retention of gas and air in ground area 20 mitigate freezing of the drain field in adverse cold weather environments. Blanket 17 and stakes 21 and 22 are also used with mound sewer drain systems. The blanket 17 covers the mound and maintained on the mound with stakes 21 and 22 extended into the ground on opposite sides of the mound.

As seen in FIG. 3, stake 21 has an elongated linear shank 23 extended into ground 13. A head 24 joined to the top end of shank 23 is an impact receiving member. A hammer or maul is used to apply impact forces on head 24 to drive shank 23 into ground 13. An inverted hook 26 joined to the upper end of shank 23 extends through grommet 19 to attach stake 21 to flange 18. Hook 26 has a downwardly and outwardly extended leg that retains the hook in grommet 19 and applies an outward lateral force, shown by arrows 27 and 28, on flange 18. The remaining stakes around blanket 17, shown in FIG. 2, have the same structure and function as stake 21.

An example of blanket 17 has a length of 6 meters and a width of 2 meters. Sheet member 31 and 32 are flexible fabric or plastic, such as polyethylene or polyester with fibers. The flange 18 is stitched to enclose a core 33 having uniform thickness throughout its width and length. Grommets 19 are tubular metal members that extend through holes in flange 18 and secure with annular rings to opposite sides of flange 18. The hooks 26 of the stakes extend through grommets 19 to retain blanket 17 in firm engagement with turf 14 over the drain field and apply opposite lateral forces to blanket 17. Blanket 17 can be transported and stored in a roller condition. In use, blanket 17 is unrolled, as shown in FIG. 1, over the drain field 10, septic tank, and tiles between building 11 and the septic tank. Blanket 17 is made of durable and lightweight materials suitable for years of reuse.

Figure 4:
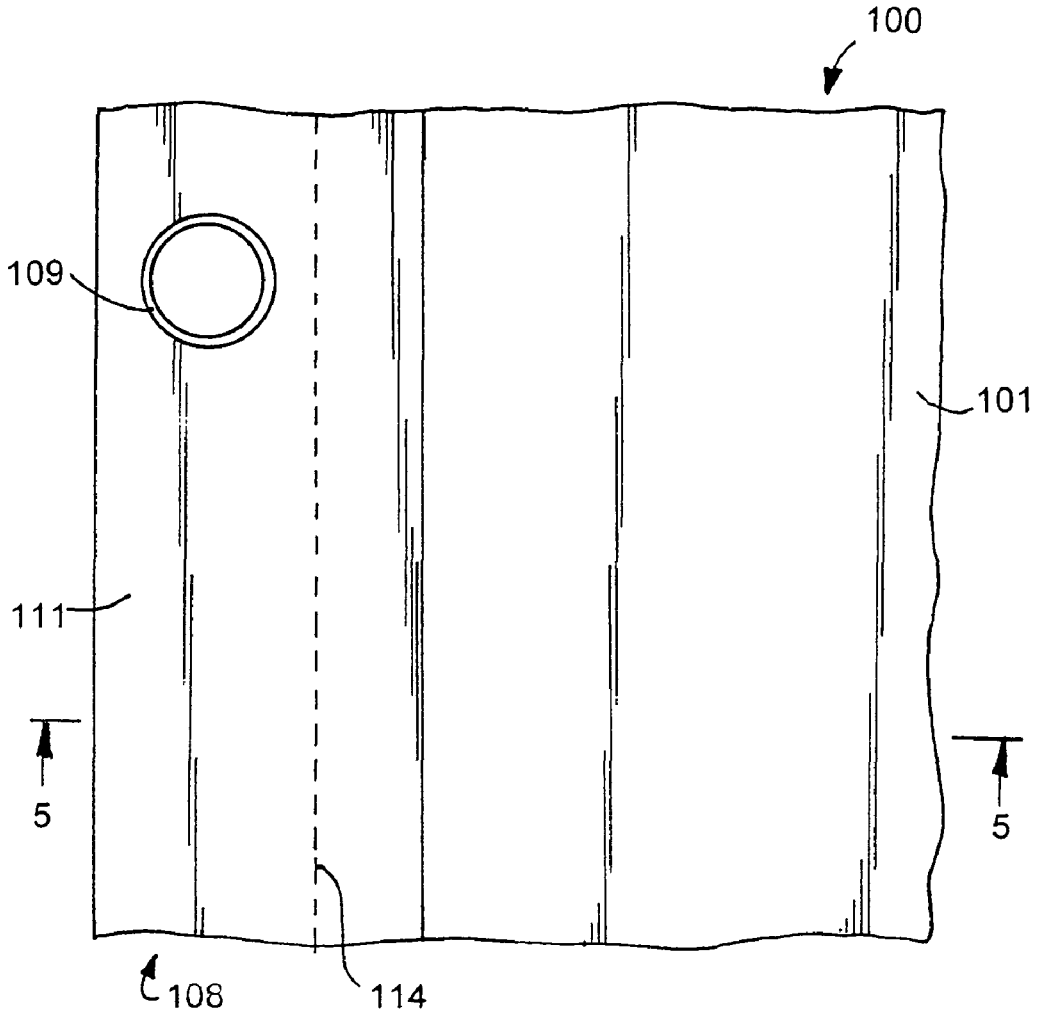
FIG. 4 is a top plan view of a section of a modified thermal insulation blanket of FIG. 1.
Figure 5:
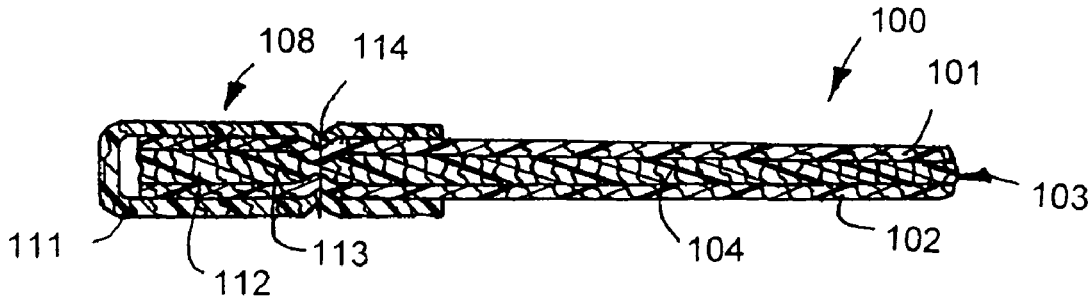
FIG. 5 is an enlarged sectional view taken along line 5-5 of FIG. 4.

A modification of the thermal insulation blanket 100, shown in FIGS. 4 and 5, has rectangular polyester fiber sheet members 101 and 102 located adjacent opposite sides of a thermal insulation core 103. The sheet members 101 and 102 are tear and puncture resistant flexible members that are water and air impervious. Each sheet member 101 and 102 has a plastic base with interengaging fibers of plastic or glass filaments. Other types of durable materials can be used for sheet members 101 and 102. The thermal insulation core 103 has a continuous body of air bubbles or air cells 104. The air cells have generally hexagonal shapes separated with flexible plastic fibers. Outer film layers are on opposite sides of the array of air cells 104. Other types of materials can be used for thermal insulation core 103.

Blanket 100 has an outer peripheral border 108 that extends around the opposite sides and ends of sheet members 101 and 102. A plurality of grommets 109 attached to border 108 are adapted to accommodate fastener such as stakes that retain blanket 100 on the ground over the sewer system. Other types of openings, such as holes reinforced with stitches, can be incorporated into border 108. Border 108 includes a U-shaped polyester sheet member 111 located around the ends 112 of sheet members 101 and 102 of end 113 of core 103. Fasteners 114, shown as stitches secure sheet member 111 to sheet members 101 and 102 and core 103. Sheet members 111 can be made of different types of materials. Also, different types of fasteners, such as heat seals can be used to secured sheet member 111 to member 101 and 102.

As shown in FIG. 5, an outer portion or end 113 of core 103 located within border 108 provides border 108 with thermal insulation. The U-shape sheet member 111 and fasteners 114 seal the outer edges of sheet members 101 and 102 and core 103 to prevent water, ice, snow, dirt and air from entering into blanket 100. The integrity and strength of border 108 is enhanced by the plurality of layers of sheet members 101, 102 and 111. An example of blanket 100, has a width of six feet or two meters and a length of twenty feet or six meters. Stakes, such as stakes 21 and 22 shown in FIG. 3, are used to secure blanket 100 to the ground. Blanket 100 can have other sizes and shapes.

While the combined sewer system and thermal insulation blankets have been disclosed and described in the foregoing specification and drawing, it is understood the modifications of the blankets and materials can be made by a person skilled in the art without departing from the invention, reference being had to the appended claims.

The invention claimed is:

1. A thermo insulated sewer water treatment environment comprising:

ground having a top surface, a sewer water treatment system located in the ground below the top surface of the ground, at least one thermal insulation blanket located on the top surface of the ground above the sewer water treatment system operable to inhibit freezing of the sewer water treatment system, said blanket comprising, first and second sheet members, a core of thermal insulation material located between said first and second sheet members, each of said first and second sheet members and core having outer peripheral side and end portions, at least one U-shaped member located around the side and end portions of the first and second sheet members and core, fasteners securing the U-shaped member to the first and second sheet member and core, a plurality of grommets secured to and extended through the U-shaped member, first and second sheet members and core, and stakes extended into the ground to retain the blanket on the top surface of the ground above the sewer water treatment system, said stakes comprising first members extended into the ground adjacent the blanket, and downward extended hooks secured to the first members engageable with the top of the U-shaped member, said hooks having portions extended through the grommets to retain the blanket on the ground above the sewer water treatment system.

2. The sewer water treatment environment of claim 1 wherein:

the ground includes a water drain field and said sewer water treatment system includes at least one water tile located in the drain field, said blanket being located on the top surface of the ground above the water tile to inhibit freezing of the water in the tile and ground around the tile.

3. The sewer water treatment environment of claim 1 wherein:

the ground includes a water drain field and said sewer water treatment system includes a septic tank and at least one tubular member located in the ground below the top surface thereof, said tubular member being coupled to the septic tank for carrying water from the septic tank to the water drain field, said blanket being located on the top surface of the ground above the septic tank and tubular member to inhibit freezing of water in the septic tank and tubular member and ground around the tubular member.

4. The sewer water treatment environment of claim 1 wherein:

the fasteners comprise stitches securing the U-shaped member to the first and second sheet members and core, and said grommets extending through said U-shaped member, first and second sheets and core outwardly of said stitches.

5. The sewer water treatment environment of claim 4 wherein:

the core of thermal insulation material is a sheet of foam plastic.

6. The sewer water treatment environment of claim 4 wherein:

the core of thermal insulation material is a body of enclosed air cells.

7. The sewer water treatment environment of claim 1 wherein:

the first and second sheet members are plastic fiber containing sheet members.

8. The sewer water treatment environment of claim 1 wherein:

said stakes have shanks extendable in the ground and said hooks extended into the grommets adapted to apply lateral forces to the blanket and hold the blanket on the top surface of the ground above the water treatment system.

9. The sewer water treatment environment of claim 1 wherein:

the U-shaped sheet member is a polyester fiber sheet member.

10. The sewer water treatment environment of claim 1 wherein:

the first and second sheet members are polyester fiber sheet members and the U-shaped sheet member is a polyester fiber sheet member.

11. A method of inhibiting freezing of a septic sewage treatment system including a septic tank and at least one tubular member connected to the septic tank to receive liquid from the septic tank located in a drain field ground below the top surface of the drain field ground characterized by providing a thermal insulation blanket having an outer peripheral border and grommets secured to and extended through the border, covering the top surface of the drain field ground above the tubular member with said thermal insulation blanket having the outer peripheral border and a plurality of grommets, and securing the blanket to the drain field ground above the tubular member with fasteners having first members extended into the drain field ground and second members secured to the first members engageable with the top of the border and the grommets to retain the blanket on the top surface of the drain field ground.

12. The method of claim 11 including:

extending a portion of the second members of the fasteners through the grommets to retain the blanket on the drain field ground over the tubular member to inhibit freezing of the liquid in the tubular member.

13. The method of claim 11 including:

covering the top surface of the ground above the septic tank with a thermal insulation blanket having a peripheral border with grommets secured to the border, and securing the thermal insulation blanket to the ground above the septic tank with fasteners having first members extended into the ground around the septic tank and second members secured to the first members engageable with the top of the border and grommets to retain the blanket on the top surface of the ground over the septic tank.

14. The method of claim 13 including:

extending a portion of the second members through the grommets to retain the blanket on the ground over the septic tank to inhibit freezing of the liquid in the septic tank.

* * * * *